United States Patent [19]

Rivere

[11] Patent Number: 4,565,168

[45] Date of Patent: Jan. 21, 1986

[54] VALVE CONTROL DEVICE, PARTICULARLY FOR VALVES OF INTERNAL COMBUSTION ENGINES

[75] Inventor: Jean-Pierre Rivere, Paris, France

[73] Assignee: Regie Nationale des Usines Renault, Boulogne-Billancourt, France

[21] Appl. No.: 574,158

[22] Filed: Jan. 26, 1984

[30] Foreign Application Priority Data

Feb. 3, 1983 [FR] France ..... 8301676

[51] Int. Cl.[4] ..... F01L 1/46

[52] U.S. Cl. ..... 123/90.34; 123/90.27; 123/196 R

[58] Field of Search ..... 123/90.27, 90.33, 90.34, 123/90.37, 196

[56] References Cited

U.S. PATENT DOCUMENTS

| | | | |
|---|---|---|---|
| 1,264,494 | 4/1918 | D'Orville | 123/90.34 X |
| 1,403,540 | 1/1922 | Church | 123/90.33 X |
| 1,469,063 | 9/1923 | Wills | 123/90.33 |
| 1,469,155 | 9/1923 | Hedberg | 123/90.33 |
| 1,617,845 | 2/1927 | Hall | 123/90.33 X |
| 1,993,992 | 3/1935 | Ford | 123/90.27 X |
| 3,045,656 | 7/1962 | Péras | 123/90.27 |
| 3,605,706 | 9/1971 | Bush | 123/90.37 |
| 4,291,650 | 9/1981 | Fornia et al. | 123/90.27 X |

FOREIGN PATENT DOCUMENTS

| | | | |
|---|---|---|---|
| 2415829 | 3/1973 | Fed. Rep. of Germany | 123/90.33 |
| 2357711 | 6/1974 | Fed. Rep. of Germany | 123/90.33 |
| 602018 | 3/1926 | France | 123/90.37 |
| 621244 | 5/1927 | France | 123/90.33 |
| 2457388 | 3/1980 | France | 123/90.33 |
| 2508995 | 7/1982 | France | 123/90.37 |
| 2056562 | 3/1981 | United Kingdom | 123/90.33 |

*Primary Examiner*—William R. Cline
*Assistant Examiner*—Peggy A. Neils
*Attorney, Agent, or Firm*—Oblon, Fisher, Spivak, McClelland & Maier

[57] ABSTRACT

A valve control device of the type having a rotating cam and a cam drive to communicate to a valve a reciprocating lifting movement in opposition to the closing force exerted by a return spring. The sliding surface of the cam drive comes in contact with the cam while immersed in an independent bath of lubricating oil having a high viscosity. Application is to a distribution device with reduced friction for internal combustion engines.

7 Claims, 3 Drawing Figures

VALVE CONTROL DEVICE, PARTICULARLY FOR VALVES OF INTERNAL COMBUSTION ENGINES

BACKGROUND OF THE INVENTION

1. Field of the Invention

This invention relates to a valve control device, particularly in an overhead camshaft engine of the type having a rotating cam and a cam drive cooperating with the cam to impart to a valve a reciprocating lifting motion, in opposition to the force exerted by a return spring to close the valve. Internal combustion engine cylinder head valves are currently controlled either directly by the cam via a lifter, or by a rocker arm, itself controlled by the cam directly or by a rod.

2. Description of the Prior Art

These solutions require lubrication by a supply of oil under pressure. This oil must have a viscosity compatible with the operation of other elements of the internal combustion engine and particularly of the bearings, for which this viscosity must preferably remain low.

However, a low viscosity disturbs the operation of the cam because high friction arises due to an extremely small thickness of the oil film located between the cam and the rocker arm or the lifter and due to the low viscosity of this film. The drive torque of the camshaft then becomes very high, particularly for small displacement engines. A further problem is wear, which is speeded up by the presence of combustion wastes including abrasive grains.

SUMMARY OF THE INVENTION

An essential object of this invention consists of eliminating said drawbacks by an arrangement of the valve control elements for an internal combustion engine.

This object of the invention is accomplished by a valve control device of a type in which the sliding surface of the cam drive comes into contact with the cam remains immersed in an isolated independent lubricating oil bath in the cylinder head, the bath having a high viscosity. This arrangement makes possible a separate lubrication of the valve control device by splashing it in viscous oil. The double requirements of cleanliness and friction reduction can thus be assured because the high viscosity favors the formation of a thick oil film between the cam and the cam drive, such as a rocker arm and a lifter.

In practice, tests have shown that the drive torque of the valve control device is reduced by half with a very viscous lubricant having a viscosity in a range of 200 to 1,000 centipoises.

The valve control device according to the invention also makes it possible to avoid a friction gain by not requiring the use of a high performance auxiliary oil pump. The cam drive consist of a rocker arm swivelling at its center on a rocker arm shaft and provided around its swivelling axis with grooves which extend into the independent oil bath. The rocker arm shaft can thus be continually lubricated by splashing. The drive means can instead consist of a lifter immersed in an upper viscous oil bath. This variant has a direct drive of the valves which makes it possible to keep the previous advantages.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
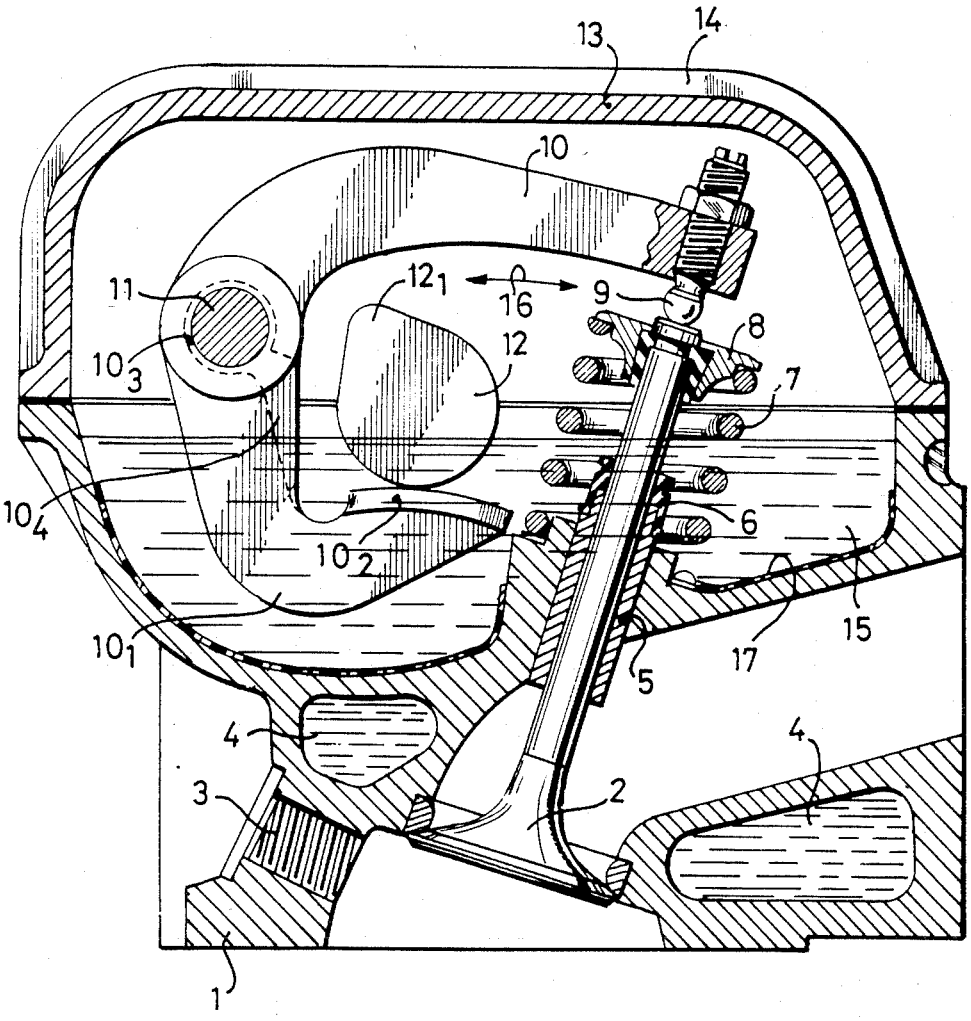
FIG. 1 shows a partial cross section view of a cylinder head of an internal combustion engine, with a cam and rocker arm valve control according to the invention.

A cylinder head 1 of an internal combustion engine is provided with valves 2, spark plug bores 3, a cooling fluid 4, valve guides 5 provided with seals 6, return springs 7, cups 8, clearance adjustment screws 9, rocker arms 10 mounted on rocker arm shaft 11 and control cams 12 (FIG. 1).

A cylinder head cover 13 having cooling fins 14 covers this cylinder head 1, which contains a viscous lubricating oil bath 15 thermally insulated from the cylinder head by an insulating covering 17.

Rocker arms 10 each have a low part $\mathbf{10_1}$ provided with a shoe $\mathbf{10_2}$ and immersed in oil bath 15. Each of these rocker arms swivels at its center on a shaft 11 and has around the bearing surface with the shaft 11 a circular groove $\mathbf{10_3}$ which connects to a lower channel $\mathbf{10_4}$ extending into bath 15.

Figure 3:
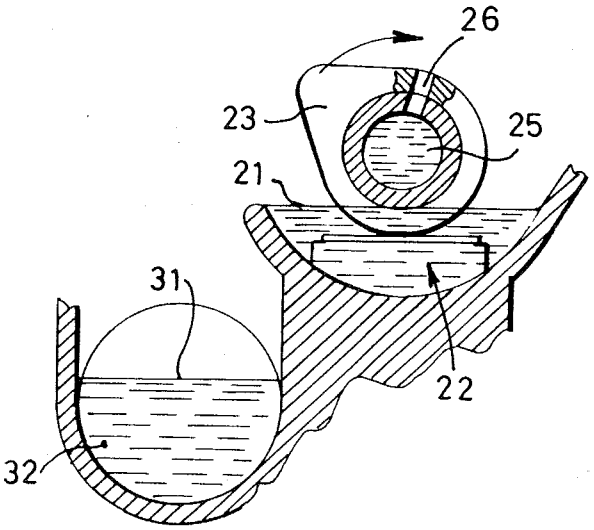
FIG. 3 is a partial view in section along line 3—3 of FIG. 2.
Figure 2:
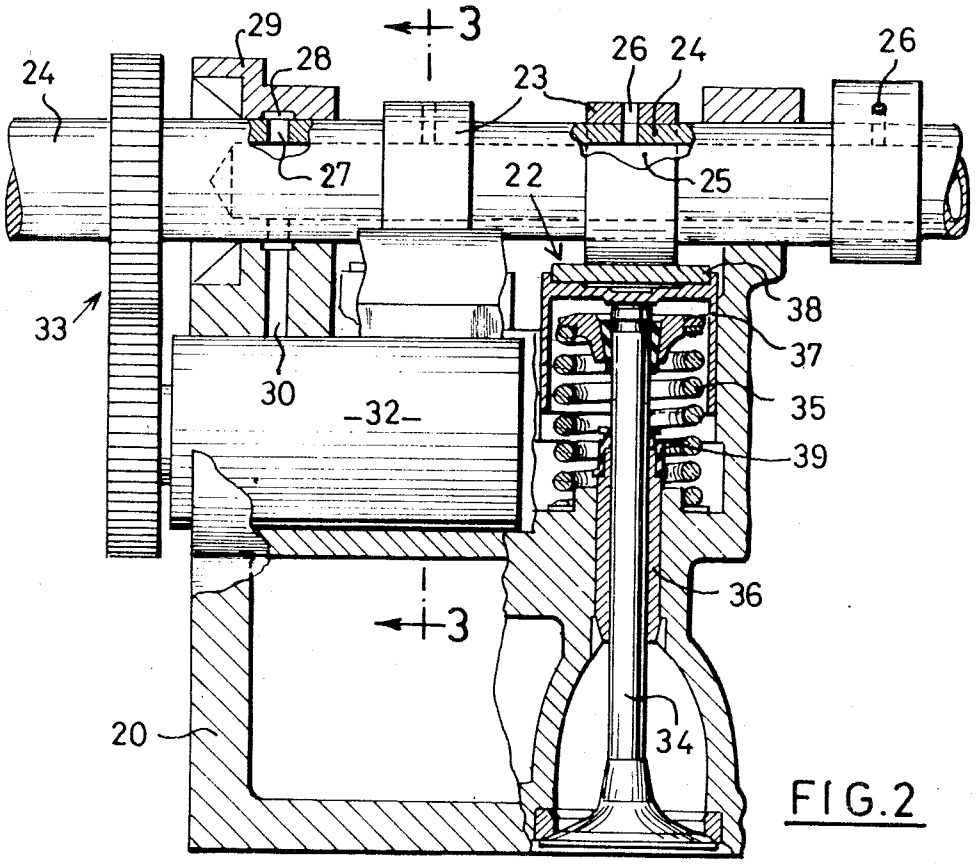
FIG. 2 is a longitudinal partial section view of a cylinder head of an internal combustion engine, with a cam and lifter valve control according to the invention.

A variant shown in FIGS. 2 and 3 illustrates an overhead valve control by an overhead camshaft with a direct drive of the valves. In these Figures are shown a cylinder head 20 provided with an upper viscous oil bath 21 in which lifters 22 driven by cams 23 are immersed. A camshaft 24 is equipped with an internal bore 25 which communicates by holes 26 judiciously made in cams 23 with the upper oil bath 21, on the one hand. The bore 25 also communicates, via a through hole 27, an inner groove 28 for a bearing 29 and a supply channel 30 opening into grooves 28, with a lower viscous oil bath 31. A low pressure oil pump 32 is driven by camshaft 24 via a gear assembly 33. As is conventional, there are also valves 34, valve return springs 35, valve guides 36, valve drive cups 37, lifter caps 38 providing the contact with cams 23 and oil seals 39 mounted on guides 36.

The valve control devices previously described operate in the following manner:

As FIG. 1 shows, low part $\mathbf{10_1}$ of rocker arm 10 is entirely immersed in the oil of bath 15. Consequently, the lubrication of the sliding surface of shoe $\mathbf{10_2}$ of this rocker arm coming in contact with the partially immersed control cam 12 is continually assured.

Cam lobe $\mathbf{12_1}$ sprays oil centrifugally into aligned groove $\mathbf{10_3}$ of rocker arm 10 through lower channel $\mathbf{10_4}$ and thus makes it possible to continually lubricate rocker arm shaft 11. Simultaneously, oil spray 16 outside oil bath 15 is sufficient to lubricate the contact surface between valve 2 and clearance adjustment screw 9. Covering 17, consisting either of an insulating material, for example plastic, or of a jet of air passing between two walls, makes it possible to maintain a sufficient viscosity for the oil of bath 15 when the engine is hot. This heat insulation limits the flow of heat which comes from cylinder head 1 to heat the oil of bath 15. Moreover, cooling fins 14 of cylinder head cover 13 contribute to removing the heat released by the friction of the valves and valve timing device. A rise in temperature of the lubricating oil is thus effectively limited.

In the variant shown in FIGS. 2 and 3, the circulation of highly viscous oil by low pressure pump 32 to independent upper bath 21, and fed by lower oil bath 31 serving as a reservoir, makes it possible to assure the continuous lubrication of the sliding surfaces of lifters 22 coming into contact with cams 23 at the caps 38.

Under the action of the low pressure pump 32, the viscous oil of bath 31 successively rises through channel 30, groove 28 and hole 27 into the oil distributor consisting of internal bore 25 of camshaft 24. Then, through holes 26 judiciously pierced in cams 23, this oil feeds upper oil bath 21 before the respective cams drive lifters 22. The viscous oil is then able to fall again into lower bath 31 serving as a reservoir and again loop in the aforementioned lubricating circuit.

As for the valve control by rocker arms and cams, seals 39 mounted on valve guides 36 best limit the consumption of oil and thermally insulating material can separate oil baths 21 and 31 from cylinder head 20.

To make the use of oils with high viscosities compatible with the good operation of the camshaft bearings and thus optimally to reduce friction, a simple solution consists in using ordinary bearings with partial arcs.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the U.S. is:

1. A valve control device for an overhead camshaft engine having a cylinder head including at least one rotatable cam on a camshaft and at least one valve, said valve control device comprising:

valve drive means extending between one said cam and one said valve for transferring rotational movement of said cam into reciprocal movement of said valve in an opening direction;

return spring means associated with each said valve for biasing said valve in a closing direction;

an isolated and independent bath of high viscosity lubricating oil in said cylinder head, wherein said valve drive means includes a sliding surface slidingly contacting each said cam, each said sliding surface being immersed in said bath; and means for circulating said oil only within said cylinder head, whereby said high viscosity lubricating oil in said isolated and independent bath in said cylinder head does not communicate with oil outside of said bath.

2. The valve control device of claim 1, wherein said bath of lubricating oil exhibits a viscosity of 200 to 1000 centipoises.

3. The valve control device of claim 1 wherein said valve drive means comprises:

a rocker arm shaft;

a rocker arm pivotable about said rocker arm shaft at a bearing surface; and grooves on said rocker arm, said grooves extending on said bearing surface and onto a surface of said rocker arm which is immersed in said bath, whereby said oil bath lubricates said bearing surface.

4. The valve control device of claim 1 wherein said oil bath comprises an upper bath and a lower bath and wherein said valve drive means comprises a lifter immersed in said upper bath.

5. The control device of claim 4 including means for feeding oil from said lower bath to said upper bath, said means for feeding comprising:

a bore in said camshaft;

a low pressure pump having an inlet in communication with said lower bath;

first conduit means feeding oil from said pump to said camshaft;

second conduit means feeding said oil from said first conduit means to said bore in said camshaft; and third conduit means communicating said bore in said camshaft with a bearing surface of each said cam.

6. The valve control device of claim 1 including a thermally insulating material separating said oil bath from said cylinder head.

7. The valve control device of claim 1 wherein said valve is mounted in said cylinder head via a guide including an oil seal.

* * * * *